US005441405A

United States Patent [19]

Bedford et al.

[11] Patent Number: 5,441,405

[45] Date of Patent: Aug. 15, 1995

[54] POWER GAS BURNER SYSTEM

[75] Inventors: James P. Bedford, Willoughby, Ohio; Wayne Hollingshead, Guelph, Canada

[73] Assignee: Cleveland Range, Inc., Cleveland, Ohio

[21] Appl. No.: 62,302

[22] Filed: May 14, 1993

[51] Int. Cl.[6] ..... F23D 14/58

[52] U.S. Cl. ..... 431/286; 431/183; 431/354; 126/110 R; 126/110 C

[58] Field of Search ..... 431/10, 351, 185, 286, 431/265, 354, 182, 183; 432/222; 126/91 R, 91 A, 110 R, 110 C

[56] References Cited

U.S. PATENT DOCUMENTS

| | | | |
|---|---|---|---|
| 3,285,316 | 11/1966 | Gustafson et al. | 431/265 |
| 3,301,308 | 1/1967 | Briggs | 432/222 |
| 3,720,496 | 3/1973 | Briggs | 431/183 |
| 4,115,050 | 9/1978 | Gerwin | 431/10 |
| 4,473,349 | 9/1984 | Kumatsu | 431/265 |
| 5,316,470 | 5/1994 | Sigler | 431/286 |

*Primary Examiner*—Carroll B. Dority
*Attorney, Agent, or Firm*—Standley & Gilcrest

[57] ABSTRACT

A gas burner system in which a turbulator disk is arranged between a burner and an opening in a combustion chamber aligned with the burner. The turbulator disk defines a central port and a plurality of peripheral voids adjacent to the central port. A burner flame, produced by ignition of a gas-primary air mixture, together with a quantity of secondary air, may be directed through the central port of the turbulator disk into the combustion chamber. A additional quantity of secondary air may be directed through the voids into the combustion chamber for combustion of the uncombusted gas from the gas-primary air mixture.

2 Claims, 3 Drawing Sheets

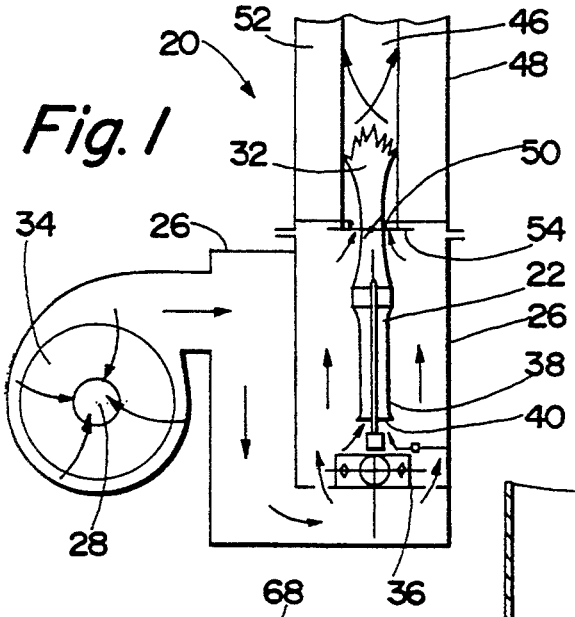
Fig. 1
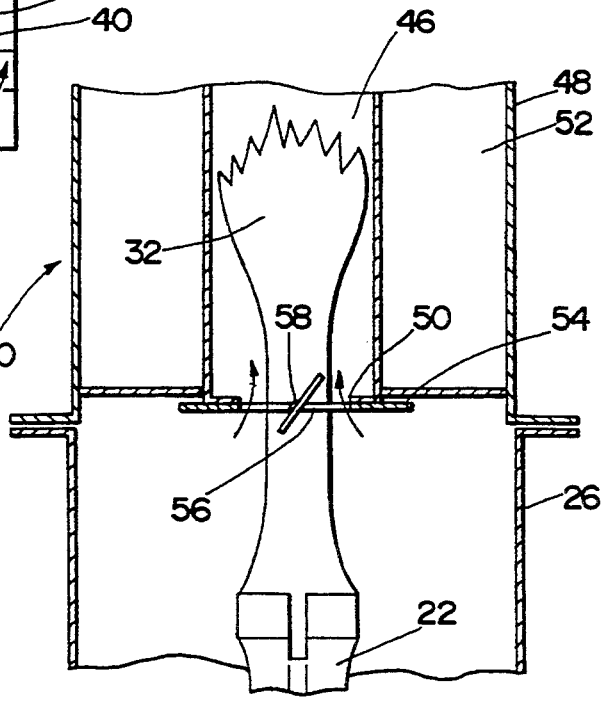
Fig. 2
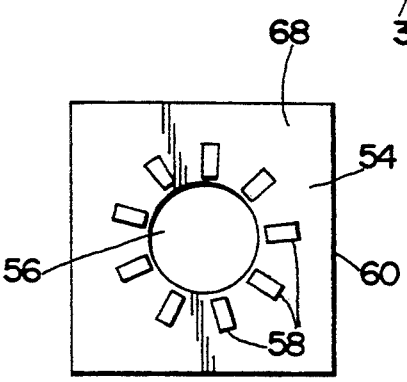
Fig. 3
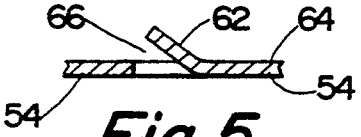
Fig. 5
Fig. 4
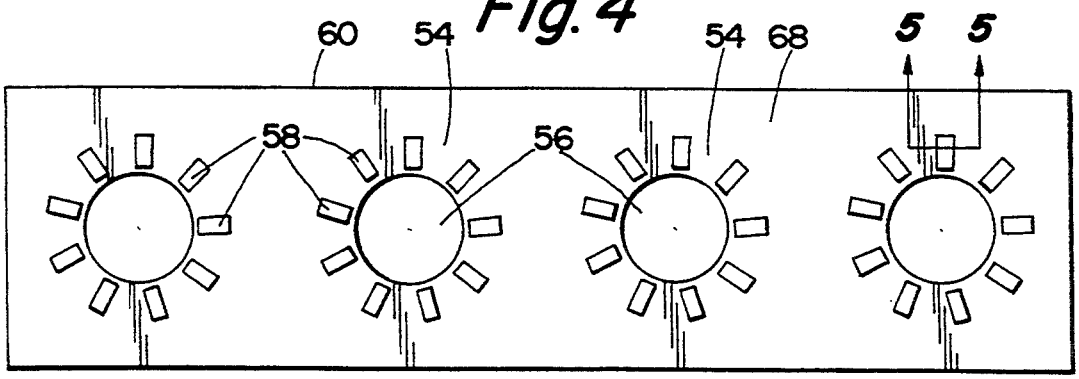

POWER GAS BURNER SYSTEM

BACKGROUND AND SUMMARY OF THE INVENTION

The present invention is concerned generally with a power gas burner system wherein the gas-primary air mixture is ignited before the mixture is introduced into the combustion chamber, and combustion is completed upon the introduction of turbulated secondary air into the combustion chamber. The present invention also is concerned with a multiplex power gas burner system having a plurality of segregated combustion chambers and a corresponding number of gas burners adapted for ignition by a single ignition source.

Gas burner systems provide means for mixing a gaseous fuel with a predetermined quantity of air, igniting the gas-air mixture, and combusting the gas-air mixture to release heat, which may be recovered by a heat exchanger. Two types of gas burners are generally known. In the first type, referred to as a secondary/primary power burner, a mixture of gas and a quantity of primary air are introduced into a combustion chamber, where the mixture is ignited. A supply of secondary air necessary to complete combustion of the gas is passed through a turbulator and introduced into the combustion chamber separately from the gas-primary air mixture. In the second type, referred to as a total premix burner, all of the air for combustion is mixed with the gas and passed through a fine-ported distribution head located within the combustion chamber. Ignition of the gas-air mixture takes place after the mixture exits the distribution head.

Each combustion chamber of the above-described burner systems requires a separate ignition source because ignition takes place within the combustion chamber. As a result, existing burner systems generally have large, complex combustion chambers with multiple heat exchanger passes, in order to minimize the number of ignition sources required. However, the complexity of the chambers offsets in part the savings associated with limiting the number of ignition sources, and the size of the chambers results in waste of heat exchanger surfaces when these burner systems are operated at reduced capacities.

In addition, the introduction of secondary air to existing burner systems prior to or at the same time as ignition renders these systems susceptible to variations in air flow. Both the ease of ignition and the stability of the burner flame generally decrease in existing burner systems as the secondary air flow rate increases. This characteristic limits the secondary air flow rates of these systems.

The operational range of a given burner system may be stated in terms of the gas turn-down ratio, i.e., the minimum gas flow rate expressed as a percentage of the maximum gas flow rate. For example, the gas turn-down ratio of a secondary/primary power system typically is approximately fifty percent whereas the gas turn-down ratio of a premix power burner system typically is only about ten percent. Existing burner systems, particularly those having large combustion chambers, may experience significant condensation and ignition problems even when they are operated in accordance with their respective gas turn-down ratios.

The gas burner system of the present invention comprises a burner and an opening in a combustion chamber aligned with the burner. A turbulator disk or plate may be arranged between the burner and the chamber opening. The turbulator disk defines a central port and a plurality of peripheral voids adjacent to the central port.

The burner communicates with both a gaseous fuel supply, such as natural gas, and an air supply. A portion of the air sufficient for ignition but not complete combustion of a predetermined quantity of gas, referred to as primary air, may be mixed with the gas. The balance of the air, referred to as secondary air, may travel past the burner toward the combustion chamber.

The gas-primary air mixture may be ignited at the burner to produce a burner flame. The burner flame and some of the secondary air may be directed through the central port of the turbulator disk into the combustion chamber. The remainder of the secondary air may be directed through the voids into the combustion chamber to provide highly turbulated air for combustion of the uncombusted gas from the gas-primary air mixture.

The burner system of the present invention may be applied to any gas fired appliance, and particularly to boilers, steam generators and water heaters. The invention, and the resultant high localized heat release associated therewith, may provide particular benefits when used in conjunction with water-backed heat exchangers. The burner system of the present invention also may be used with air-backed heat exchangers, provided that the operating conditions of the burner system are matched to the materials used in the heat exchangers to prevent the heat exchangers from being damaged by exposure to the high localized temperatures produced by the burner system.

The gas burner system of the present invention and many of its attendant advantages may be more readily understood in view of the following drawings and detailed description.

BRIEF DESCRIPTION OF THE DRAWINGS

FIG. 1 is a sectional diagrammatical view of a burner system of the present invention;

FIG. 2 is a detail view of a portion of the burner system of FIG. 1;

FIG. 3 is a top plan view of a turbulator disk of the present invention;

FIG. 4 is a top plan view of a plate having a plurality of turbulator disks therein;

FIG. 5 is a sectional view along line A—A of FIG. 4, showing a louver in a turbulator disk;

DESCRIPTION OF PREFERRED EMBODIMENT(S)

Figure 6:
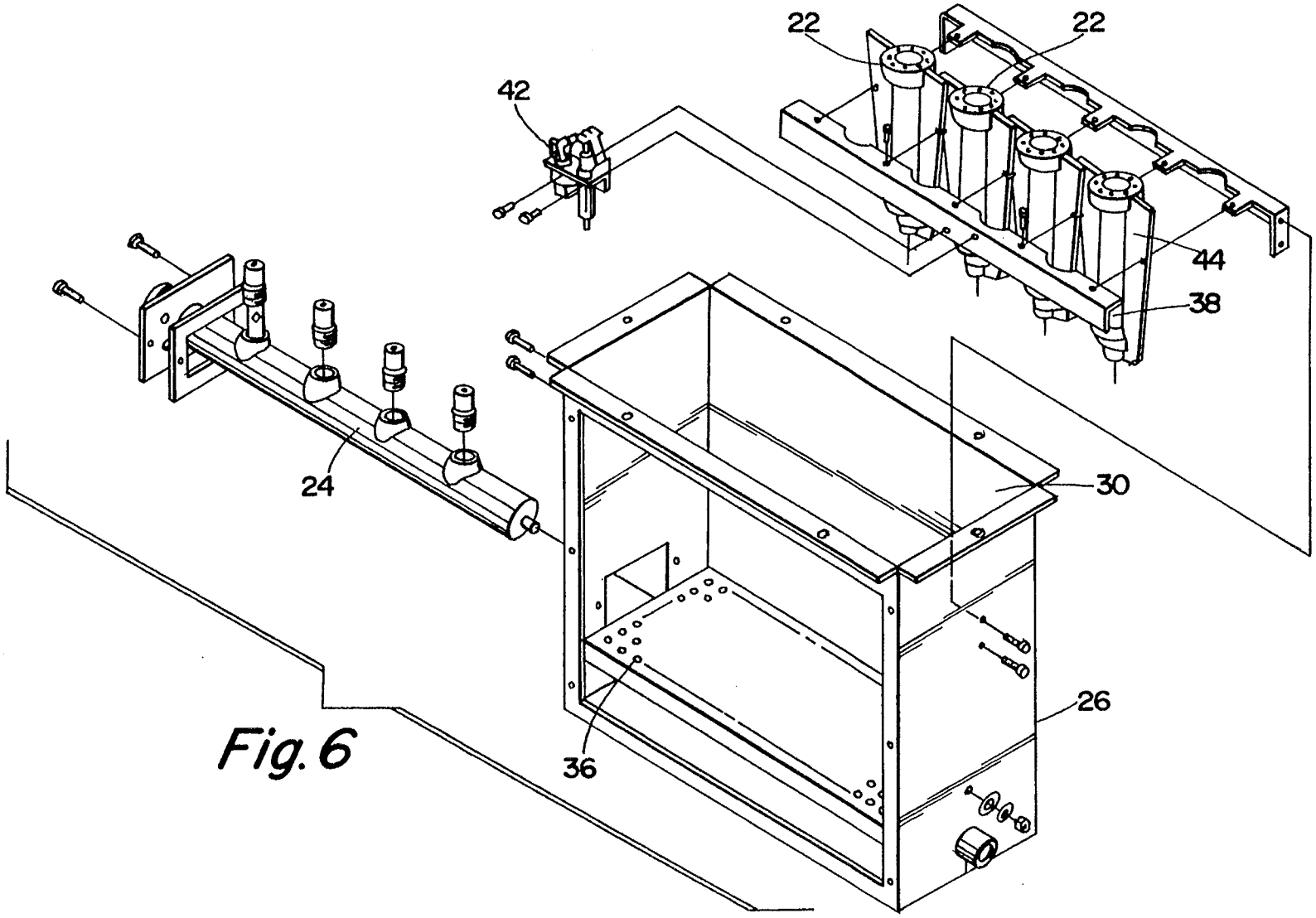
FIG. 6 is an exploded perspective view of a multiplex burner.
Figure 7:
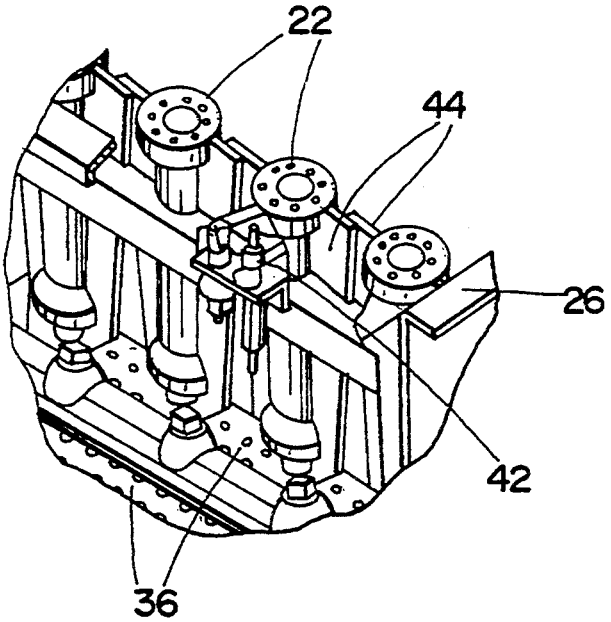
FIG. 7 is an assembled detail view of a portion of the multiplex burner of FIG. 6.
Figure 8:
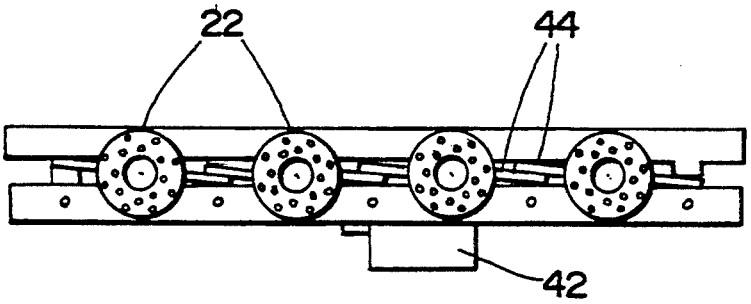
FIG. 8 is an assembled top plan view of the multiplex burner of FIG. 6.
Figure 9:
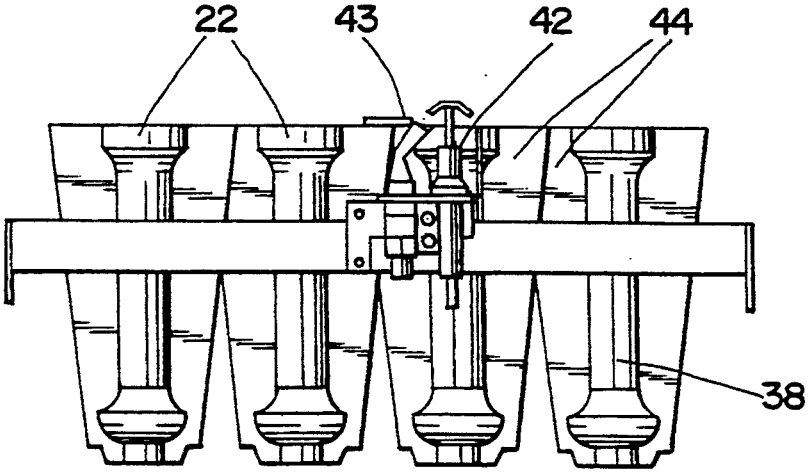
FIG. 9 is an assembled side elevational view of the multiplex burner of FIG. 6.

FIGS. 1 and 2 show a burner system 20 of the present invention. The burner system 20 may include a burner 22, preferably a monoport burner, such as the SP438 burner available from Beckett Gas inc. The burner 22 may be connected to a regulated gas supply, for example, by a gas manifold 24, as shown in FIG. 6.

The burner 22 may be located within a burner box 26. The box 26 defines an inlet 28 through which air may enter the box 26 and an outlet 30 through which the burner flame 32 may project and through which air may exit the box 26. A blower 34 may be provided in association with the box 26 to supply air to the system 20 in the vicinity of the burner 22. Preferably, the blower 34 directs air upwardly in the area of the burner 22. A diffuser 36 may be provided between the blower 34 and the base 38 of the burner 22 to diffuse the air from the blower 34.

The burner 22 may have ports 40 adjacent its base 38. A portion of the air sufficient for ignition but not complete combustion of a predetermined quantity of gas, referred to as primary air, may be directed through the ports 40. The burner 22 may include means for mixing the primary air with a predetermined quantity of gas to produce a gas-primary air mixture. An ignition source 42 may be provided in association with the burner 22 for igniting the gas-primary air mixture at the burner 22 to produce a burner flame 32. A flame prover 43 may be provided for detecting the presence of a flame at the burner 22 or at a pilot-typeignition source 42.

The remaining, or secondary, air, in a quantity sufficient for complete combustion of the gas in the mixture, may travel past the burner 22 and through the outlet 30 in the burner box 26. The path of the air from the inlet 28 through the blower 34 and to the burner ports 40 or the outlet 30 is shown by arrows in FIG. 1.

The combustion chamber 46 may comprise an enclosure 48 arranged above the burner box 26. The combustion chamber may define a chamber opening 50 spaced from and aligned with the burner 22, for receiving a burner flame 32. The combustion chamber 46 also may define an exhaust vent, not shown in the drawings, for exhausting combustion products. Water- or air-backed heat exchangers 52 may be provided within the enclosure 48 for recovering heat from the combustion process. The combustion chamber 46 and heat exchangers 52 may be of any suitable design and construction.

A turbulator disk or plate 54 may be arranged between the burner 22 and the combustion chamber 46 adjacent the chamber opening 50. The turbulator disk 54 may define a central port 56 and a plurality of peripheral voids 58 adjacent to the central port 56, as shown in FIG. 3. The turbulator disk 54 may be formed from a plate 68 of 430 stainless steel or any other suitable material.

The central port 56 of the turbulator disk 54 may be of any size or shape that will accommodate passage of both the burner flame 32 and a portion of the secondary air from the outlet 30 to the combustion chamber 45, and direct the burner flame 32 to a desired position within the combustion chamber 46. The voids 58 of the turbulator disk 54 may be of any shape, size, or configuration that provides highly turbulated secondary air to the combustion chamber 46. The voids 58 may take the form of slits arranged radially about the central port 56. The slits 58 may be spaced from both the perimeter 60 of the disk and the central port 56. Each of the slits 58 may be spaced equally from the slits 58 adjacent thereto.

The slits 58 may comprise slots cut into the disk 54. The cuts may be made at a predetermined angle relative to the disk surface 64. The slits 58 also may comprise cut tabs that are bent to form louvers 62, as shown in FIG. 5. The louvers 62 may be bent upwardly or downwardly relative to the surface 64 of the disk 54. In one embodiment of the invention, a plurality of louvers 62 extend upwardly from the disk surface 64 at an angle of 40 degrees, each defining a slot 66 approximately 0.06 inches high through which secondary air may pass.

In another embodiment of the invention, the burner system 20 may include a plurality of burners 22 arranged in a predetermined pattern, as shown in FIGS. 6–9. In such a system, the burners 22 may be provided with integral or auxiliary means for cross-lighting 44 the burners 22. The cross-lighting means 44 causes the flame from the ignition source 42 to travel from one burner 22 to another in a predetermined path such that the burners 22 can be ignited sequentially by a single ignition flame. In such a multiplex burner system, a plurality of turbulator disks 54 may be provided within a single plate 68 in an arrangement corresponding to the pattern of the burners, as shown in FIG. 4.

A preferred operation of the above-described burner system 20 is as follows. The blower 34 may provide primary and secondary air to the system 20 in the vicinity of the burner 22. The burner also may be provided with a supply of gas. Primary air may enter ports 40 in the burner 22 and mix with gas to form a gas-primary air mixture. An ignition source 42 may ignite the gas-primary air mixture at the burner 22 to produce a burner flame 32. The secondary air may travel past the burner 22 toward the combustion chamber 46.

The burner flame 32 and some of the secondary air may be directed through the central port 56 of the turbulator disk 54 into the combustion chamber 46. The secondary air that is directed through the central port 56 of the turbulator disk 54 may be heated as it passes in close proximity to the burner flame 32. The preheating or conditioning of a portion of the secondary air promotes rapid combustion in the combustion chamber 46 of the uncombusted gas from the gas-primary air mixture. The secondary air that is directed through the central port 56 also may insulate the turbulator disk 54 from the burner flame 32, which tends to prolong the life of a given disk 54. This insulating effect also allows the disk to be constructed of relatively inexpensive, less heat-resistant materials than would otherwise be required in such an application.

The remainder of the secondary air may be directed from the burner box outlet 30 through the voids 58 into the combustion chamber 46. The secondary air that is directed through the voids 58 is turbulated as it passes through the voids 58, providing highly turbulated air for combustion with the uncombusted gas from the gas-primary air mixture. The turbulated secondary air produces a short burner flame 32 and high localized heat release within the combustion chamber 46. The heat released by combustion may be recovered by heat exchangers 52 within the enclosure 48. Combustion products may exit the combustion chamber 46 through an exhaust vent.

The gas burner system of the present invention results in improved burner performance over a range of operational conditions. The gas turn-down ratio of one preferred embodiment of the present,invention is as low as thirty percent. Lower gas turn-down ratios also may be achievable and are within the scope of the present invention. The claimed invention also allows the use of a plurality of small combustion chamber-burner cells, all serviced by a single ignition source, rather than a single large combustion chamber-burner combination. The size of the burner system therefore may be adjusted easily by adding or removing one or more cells. In addition, use of small combustion chambers allow more efficient heat recovery over a range of operational conditions than the large, complex chambers of existing burner systems.

The gas burner systems described above are merely preferred embodiments of the present invention. The above-described preferred embodiments should not be construed as limiting and are susceptible to modification by one skilled in the art. Such modification is considered to be within the spirit of the present invention and under the protection of the following claims.

What is claimed is:

1. A gas burner system, comprising:

a burner, a combustion chamber defining an opening aligned with said burner, and a turbulator disk defining a central port and a plurality of voids adjacent to said central port, said disk arranged between said burner and said chamber opening such that a burner flame resulting from ignition of a fuel gas and a first quantity of air at said burner is directed through said central port into said combustion chamber and a second quantity of air is directed through said voids into said combustion chamber, said burner, said chamber, and said disk together defining a first burner system;

at least one additional burner system arranged in a predetermined location relative to said first burner system, said additional burner system comprising a burner, combustion chamber, and disk arranged in substantially the same way as in said first burner system; and a cross-lighting mechanism associated with the burner of said first burner system and the burners of each of said additional burner systems such that a single ignition source may ignite sequentially each of said burners.

2. A multiplex gas burner system, comprising:

at least two burners arranged in a predetermined pattern, said burners associated with a cross-lighting mechanism for igniting said burners from a single ignition source;

a combustion chamber in association with each of said burners, each of said combustion chambers defining an opening aligned with one of said burners; and a plate defining a plurality of turbulator disks arranged in a pattern corresponding to the pattern of said burners, each of said disks comprising a central port and a plurality of voids adjacent to said central port, said plate arranged between one of said burners and a corresponding chamber opening such that a burner flame and a first quantity of air may be directed through said central port into said combustion chamber and a second quantity of air may be directed through said voids into said combustion chamber in a turbulated condition as a result of passing through said voids.

* * * * *